US005080608A

United States Patent [19]

Yarnton et al.

[11] Patent Number: 5,080,608

[45] Date of Patent: Jan. 14, 1992

[54] ELECTRICAL PLUG CONNECTOR

[76] Inventors: William W. Yarnton, 22 Kennedy Crescent, Regina, Sask., Canada, S4R 6G4; William J. Rouse, 2448 Reynolds St., Regina, Sask., Canada, S4N 3N7

[21] Appl. No.: 534,201

[22] Filed: Jun. 6, 1990

[30] Foreign Application Priority Data

Jun. 5, 1990 [CA] Canada ..... 2018232

[51] Int. Cl.[5] ..... H01R 13/58

[52] U.S. Cl. ..... 439/457; 439/465; 439/460; 439/694

[58] Field of Search ..... 439/445, 449, 606, 450–452, 439/456–461, 465, 470, 660, 686, 687, 689–696

[56] References Cited

U.S. PATENT DOCUMENTS

| | | | |
|---|---|---|---|
| 1,518,639 | 12/1924 | Reamer | 439/456 |
| 1,601,255 | 9/1926 | Marra | 439/460 |
| 2,573,600 | 10/1951 | Pruehs | 439/457 X |
| 2,675,531 | 4/1954 | Sams et al. | 439/457 X |
| 2,959,763 | 11/1960 | Lippel | 439/694 |
| 3,904,265 | 9/1975 | Hollyday et al. | 439/687 X |
| 4,493,523 | 1/1985 | Leong et al. | 439/460 |

FOREIGN PATENT DOCUMENTS

| | | | |
|---|---|---|---|
| 0568678 | 4/1945 | United Kingdom | 439/460 |

*Primary Examiner*—Daniel W. Howell
*Assistant Examiner*—Julie R. Daulton

[57] ABSTRACT

Electrical conductor cord connections including male and female connectors. The male cord connector has fixed prongs protruding in parallel from a face on the body of the connector. A conductor cord is connected to the prongs internally of the body, the connections are covered and the cord held by an end cap fastened to the body with the conductor cord emerging from the body in the same direction as, and parallel to, the prongs. A notch has been provided in the body to allow the conductor to be forced to a right angled location for wall receptacle installation of the male prongs. The female connector has a similar body but with the male prongs being replaced by receptacles, the end cap and notch again being provided. A connection using the above male and female connectors ensure an inseparable connection when tension is put on the electrical conductor cords attached thereto.

6 Claims, 2 Drawing Sheets

ELECTRICAL PLUG CONNECTOR

FIELD OF INVENTION

This application relates to electrical plug connectors and more particularly to the disconnect preventing type.

BACKGROUND OF INVENTION

Portable extension cords with their necessary connecting ends date back to the origin of flexible electrical conductors that needed to be connected or disconnected almost instantaneously. Many shapes and forms made of various materials have reached the market. Some of the ends are replaceable others have now been molded in with the cord, while this is excellent as far as moisture is concerned it presents a problem in so far as repair is concerned.

Other problems have arisen not the least of which is the tendency of extension cords to disconnect from the power cord when a tensile force is applied. The most common remedy for this problem has been to tie the connection together but this has not always met with the greatest success. A search of the prior art has been carried out but nothing of any consequence was revealed. Applicants reversed direction cord appears to be the only reasonable solution to this problem.

SUMMARY OF THE INVENTION

The present invention is directed to the connecting of electrical conductors and their end connections. The end connections are usually in the form of a male connector and a female connector. The male connector having prongs to be received in receptacles of the female connector. The cord is electrically connected to the connectors on terminal ends on the inside of the body of the connector. The cord is received in a channel on the body to redirect its normal path to one where it emerges from the body parallel to and in the same direction as the prongs or receptacles. A notch is generally found at the end of the channel where the cord emerges so that the cord may be forced therein to have it redirected so that a male connector may be received in a wall outlet in a flush position. The main thrust of this invention is that a tool with applicants new type male connector can be connected to an extension cord having a cooperating new type female connector without any possibility of connection separation upon application of a tensile force.

In view of the above it is an object of this invention to provide a connection that precludes separation upon application of a tensile separating force.

It is a further object of this invention to provide a male cord connector capable of establishing a cord connection whereby the cord emerges from the connector in the same direction as the male prongs.

It is a further object of this invention to provide a female cord connector capable of establishing a cord connection whereby the cord emerges from the connector in the same direction as the openings of the female receptacles.

It is a further object of the instant invention to provide a male connector capable of a flush wall receptacle installation by a temporary redirection of the connector cord.

It is a further object of the present invention to induce a more positive connection upon application of a normally separating force.

It is yet a further object of the present invention to provide an inexpensive, easily manufactured positive electrical cord connection.

These and other objects of the present invention will become readily apparent as the following description is read in conjunction with the accompanying drawings wherein like reference numerals indicate like elements throughout the several views.

DETAILED DESCRIPTION

Figure 1:
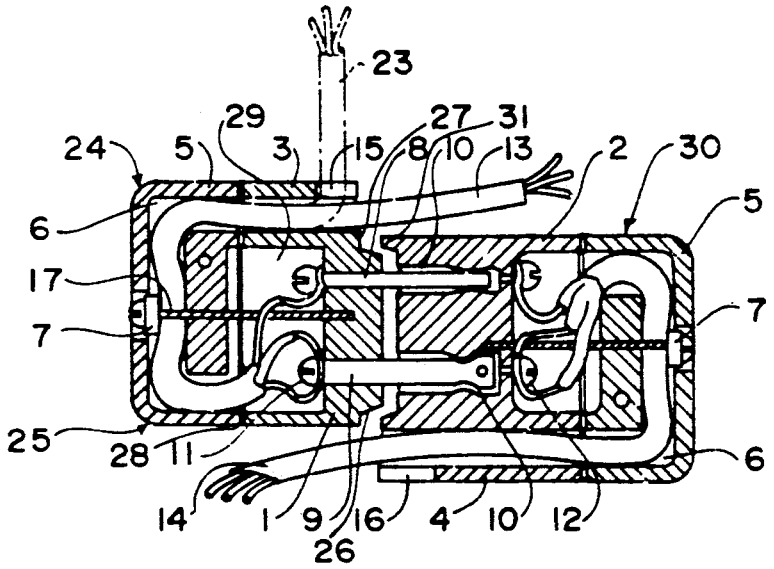
FIG. 1 is a sectional view in elevation of the instant invention

Now referring to the drawings there is shown in FIG. 1 an electrical cord connection comprising a male cord end 25 connected to a female cord end 30. The male cord end has a male prong body 1 normally formed of rubber or plastics with prongs 8 and 9 fixed therein and having prong terminals 11 for connecting the conductor wires thereto. The body 1 has a body cord channel 3 integrally or releasibly attached thereto to guide the exit of the electrical cord in a direction away from the body 1 in the same direction as the prongs 8 and 9. A lock notch 15 has been provided at the exit opening of the cord channel 3. The electrical conductor 13 when forced into the lock notch 15 will remain therein in a position 23 to enable the male cord end to be installed flush with a wall receptacle. The lock notch 15 may be at an angle to the axis of the body cord channel 3 if necessary to prevent the cord 13 from too easily taking on the alternate location 23. The male cord end further has an end cap 24 formed of two identical halves 5 united by assembly screw means 18 and held firmly against the male prong body by an end cap mounting screw 17 which carries an electrical cord clamp 7. The two halves 5 form a cord channel 6 which carries the electrical cord 13 from the terminals 11 to the body cord channel 3. The end cap 24 on the male cord end 25 is identical to the end cap on the female cord end 30 but is connected to the female receptacle body 2 which is again formed of a rubber or plastic or other insulating material and carries female receptacles 10 with terminals 12. The female receptacle body 2 also includes a body cord channel 4 and a cord channel lock notch 16, the same as lock notch 15. The cord 14 emerges from the female body cord channel 4 in the same direction as the receptacles 10. The conductors are attached to the receptacles 10 by receptacle terminals 12 then pass through channel 6 formed by end cap halves 5, the same as the male body end cap, and pass through female receptacle body cord channel 4 to the outside.

Figure 2:
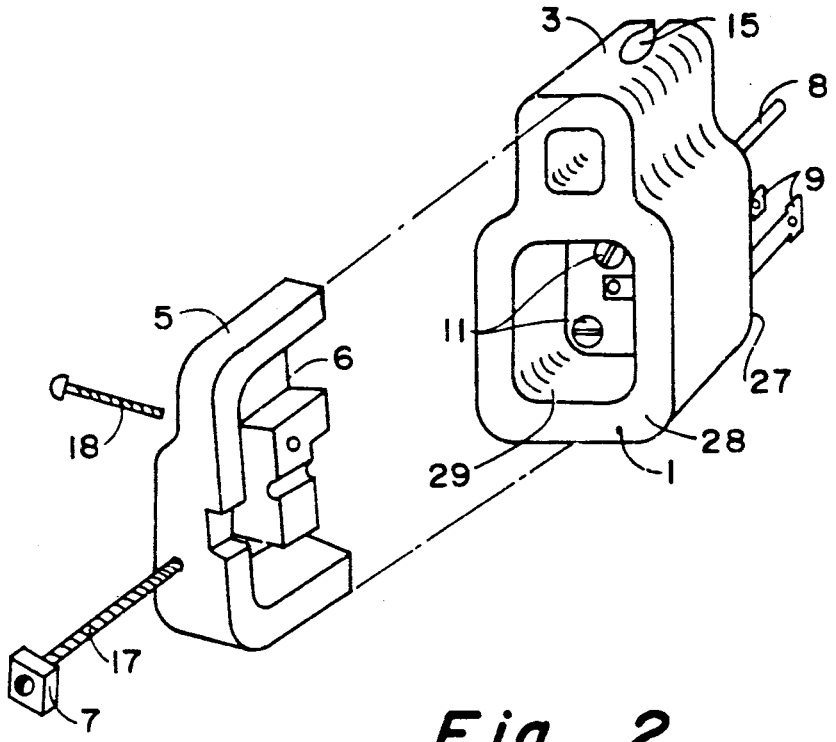
FIG. 2 is a perspective view of the body and one half of the end cap of the male plug cord connector

Referring briefly to FIG. 2 there is shown in exploded perspective the male prong body 1 with attached male prong body cord channel 3, and displaced therefrom is one half 5 of end cap 24 with its assembly screw 18 mounting screw 17 and one half of channel 6.

Figure 3:
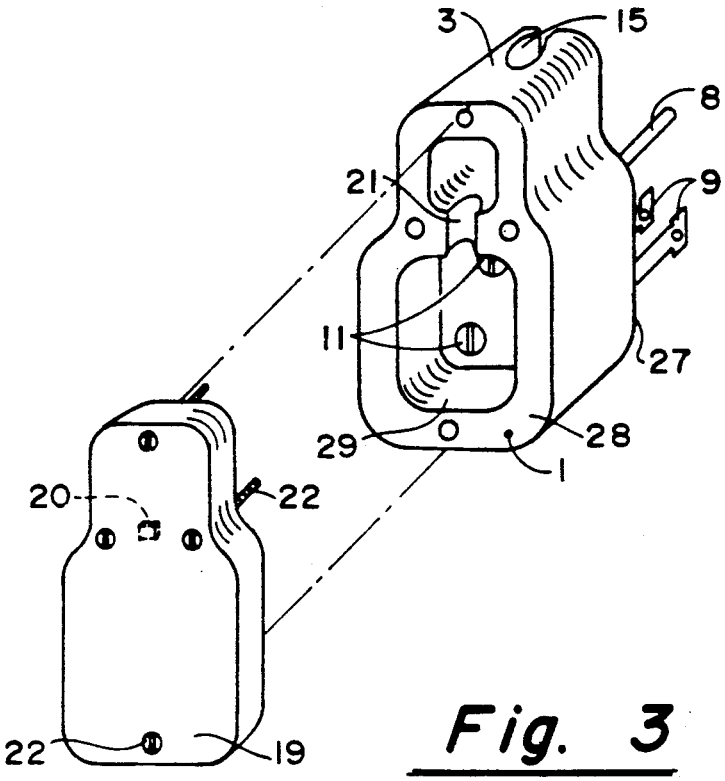
FIG. 3 is a further embodiment in perspective of the male plug cord connector

Now referring to FIG. 3 there is shown again the main prong body 1 with attached male prong body cord channel 3 having a cord lock notch 15 at the outer end thereof. The male prongs 8 and 9 emerge from a face of the male body 1 in a parallel relationship and perpendicular thereto. This further embodiment is characterized by a notch 21 in the partition connecting the male prong body channel 3 and the male prong body 1, which receives the electrical cord. The electrical cord is clamped firmly in place by a protrusion 20 on end plate 19 affixed to male prong body 1 by mounting screws 22. This embodiment simplifies the rerouting of the electrical cord to its desired emerging location.

Figure 4:
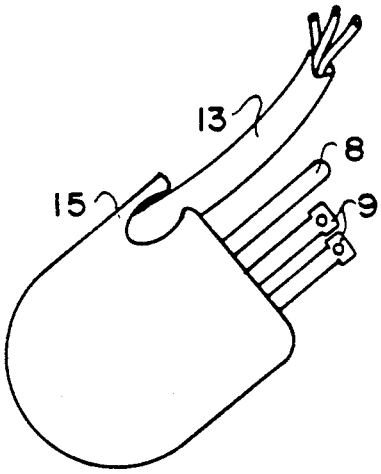
FIG. 4 is a further embodiment in perspective of the male plug cord connector in molded form.

Referring briefly to FIG. 4 we have the prongs 8 and 9, and connected electrical cord 13 all molded in a unitary prong body, end plate, and channel, with the body channel having at the exit a lock notch 15.

Operation

The above described male female connection, or the male connection "Per Se", or the female connection "Per Se" has been found most useful when preventing disengagement and resultant loss of electrical power at the most inopportune time. The utility is established by having the electrical cord ends fastened to the terminals, of the male or female body on the inside thereof, the electrical cord is then placed in one or a series of continuous channels as the case may be and clamped there by an end cap, end plate or molding as the case may be to ultimately emerge from the cord end in the same direction as the prongs or receptacles and in a parallel relationship thereto. When the occasion arises that a flush mounting is required by either the male cord end such as into a wall receptacle, or the female cord end, the electrical cord is forced into a lock notch to accommodate such a mounting.

While the description and drawings have been related more closely to the male cord end with its prongs it must be realized that really the only difference between the cord end is that the female cord end has receptacles.

Although the invention has been described with a certain degree of particularity it is understood that the present disclosure has been made only by way of example and that numerous changes in the details of construction and the combination and arrangement of parts may be resorted to without departing from the spirit and scope of the invention as hereinafter claimed.

We claim:

1. A male cord end for an electrical conductor cord comprising in combination: a unitary male prong body; male prongs passing through said body and fixed thereto; prong terminals attached to the prongs to receive the electrical cord conductors; a tapered peripheral edge on the prong body to cooperatively engage a tapered female receptacle body; the male prong body being parallel to a longitudinal axis of the male prongs; a cord channel integrally mounted on said male prong body parallel to the longitudinal axis of the male prongs; an electrical cord engaging notch in a portion of the cord channel furthest from the prong body mounting and adapted to enable a right angle bend of the cord away from the prong body to permit the male cord end to be received in a wall receptacle; an end cap releasably attached to the male prong body and attached cord channel comprising a second cord channel extending from the prong body mounted cord channel to the terminals of the male prongs and formed by two similar halves each with a cooperating continuous groove; said similar halves being united by a threaded fastener, a cord clamp, a second fastener carrying said cord clamp and releasably fixing said end cap to said male prong body.

2. A male end for an electrical conductor cord comprising: a unitary male prong body having an end face; male prongs mounted in said body and emerging in parallel from said body member end face and having terminals attached thereto to receive the electrical conductors of the cord; removable end cover means in the form of a flat end plate on a prong body end opposite said prong body end face and fastened to said male prong body; a cord channel integrally jointed to said unitary male prong body; said cord channel being parallel to said body member and terminating in a plane containing said end face to hold the cord so that it emerges from the cord channel in a direction parallel to said male prongs; wherein said removable end cover means has a protrusion means for clamping a portion of the electrical cord, and said removable end cover means is secured to said unitary male prong body with mounting screws.

3. A male end for an electrical conductor cord as claimed in claim 2 further including an electrical cord engaging notch in said cord channel at said body member end face to accept the electrical conductor cord in a right angle relationship to said prongs to enable reception of said prongs in a wall plug.

4. A male end for an electrical conductor cord as claimed in claims 2 or 3 wherein the cord channel integral joint between the male prong body and the cord channel has a recess at the end opposite said body end face near the terminals to receive said portion of the electrical cord for clamping.

5. A male end for an electrical conductor cord as claimed in claim 4 wherein said protrusion means clamps said portion of the electrical cord into said recess.

6. A male end for an electrical conductor cord as claimed in claims 2 or 3 further including a tapered peripheral edge on the prong body to cooperatively engage a tapered female receptacle body.

* * * * *